US005110453A

United States Patent [19]

Montgomery

[11] Patent Number: 5,110,453

[45] Date of Patent: May 5, 1992

[54] SPLIT FEED REJECT CLAIMER

[75] Inventor: James R. Montgomery, Portland, Oreg.

[73] Assignee: Beloit Corporation, Beloit, Wis.

[21] Appl. No.: 571,048

[22] Filed: Aug. 22, 1990

[51] Int. Cl.[5] ..... B07B 4/04; B07B 11/06

[52] U.S. Cl. ..... 209/135; 209/149

[58] Field of Search ..... 209/20, 134–137, 209/146, 147, 149, 150

[56] References Cited

U.S. PATENT DOCUMENTS

| | | | |
|---|---|---|---|
| 114,023 | 4/1871 | Miller | 209/135 |
| 1,801,392 | 4/1931 | Steidle | 209/137 |
| 2,828,011 | 3/1958 | Whitby | 209/20 |
| 3,384,233 | 5/1968 | Bolles . | |
| 4,022,439 | 5/1977 | Groth | 209/135 X |
| 4,486,300 | 12/1984 | Prieb | 209/135 |

FOREIGN PATENT DOCUMENTS

| | | | |
|---|---|---|---|
| 0413291 | 5/1925 | Fed. Rep. of Germany | 209/137 |
| 0400326 | 7/1909 | France | 209/137 |
| 0828125 | 5/1938 | France | 209/137 |
| 1181399 | 6/1959 | France | 209/136 |
| WO87/06506 | 11/1987 | PCT Int'l Appl. | 209/135 |
| 0038686 | 1/1907 | Switzerland | 209/146 |
| 1247106 | 7/1986 | U.S.S.R. | 209/135 |
| 1475728 | 4/1989 | U.S.S.R. | 209/136 |
| 0346481 | 4/1931 | United Kingdom | 209/135 |

*Primary Examiner*—Michael S. Huppert
*Assistant Examiner*—Edward M. Wacyra
*Attorney, Agent, or Firm*—Dirk J. Veneman; Raymond W. Campbell

[57] ABSTRACT

A method and apparatus for separation and cleaning of fibers for papermaking machines for the removal of reject material such as tramp iron and knots, delivering a flow of fibers with mixed reject material and releasing the flow to descend gravitationally downwardly, splitting the flow into plural streams and deflecting the streams with an adjustable panel to control the angle, directing jets of air across the descending streams so that heavier reject materials falls downwardly and the fibers are carried laterally outwardly of each of the streams with a plate at the base of the streams adjustable to vary the zones for the rejects and for the acceptable fibers.

11 Claims, 3 Drawing Sheets

SPLIT FEED REJECT CLAIMER

BACKGROUND OF THE INVENTION

The present invention relates to improvements in mechanisms and method for the preparation of stock for papermaking machines, and more particularly to a system for the removal of tramp reject materials from acceptable fibers.

In tramp reject removal systems heretofore available, air nozzles have been employed which incur a high fiber loss which is obviously undesirable. These have proven no more efficient than other systems which employ floating velocity arrangements for the removal of tramp materials. In systems now available, the ineffectiveness is caused primarily by the thick burden of material which has to be affected by the nozzled air flow. The nozzle arrangement becomes critical. This is because there is a need to continue forcing or checking material as it twirls, flips and falls progressively downwardly optimizing the separation between the acceptable fibers and the tramp material, such as tramp iron knots and the like. The systems in other industries have utilized a flow of separation air to separate or stratify materials. Examples of these are shown in U.S. Pat. No. 2,828,011 which is designed for the classification of materials such as middling stocks in flour mills wherein airstreams are arranged to separate different grades of material of ground flour. Another example is U.S. Pat. No. 3,384,233 which is designed for the cleaning of sugar cane and uses air flow to separate leafy trash from the stream. The principle of these and other devices using air flow for separation are impractical for the problems faced in the purification or cleaning of papermaking fibers. Such fibers must be free of tramp iron, large knots and other impurities as they are processed and pulped prior to being dewatered and formed into a web and further dried in a papermaking machine.

An object of the present invention is to provide an apparatus and method for the cleaning of papermaking fibers by the removal of tramp reject materials which avoids the disadvantages of systems heretofore used and which avoids unnecessary fiber loss.

A further object of the invention is to provide an improved system employing air injected crosswise into a stream of fibers for the separation of tramp material from usable fibers.

A further object of the invention is to provide an overall improvement in systems preparing pulp for papermaking by the purification or cleaning of fibers with the removal of materials which cannot be tolerated in pulp preparation and paper web forming.

FEATURES OF THE INVENTION

In accordance with the principles of the invention, the method utilizes a split feed of a supply of fibers containing tramp material. With the split feed, multiple streams are formed thereby reducing the thickness of the bed of material which needs to be handled and particularly which is affected by high velocity air directed laterally of the stream. This arrangement provides for a reduced likelihood of a binding effect or a pushing of large materials through the rest of the flow. It also accomplishes a higher tramp removal efficiency and lessens the loss of good fibers by allowing more of the chips and other material to be cross-sectionally checked or acted on with increased frequency thereby providing more free area available.

A supply of the fibers is released to descend downwardly and is divided into plural flows which are deflected from 15° to 20° off vertical at an adjustable angle. This provides a slope to the falling material streams with a greater distribution and high velocity air is directed across the streams at a controlled distance. The jets of high velocity air are spaced outwardly in a downward direction to somewhat follow the deflected streams. Adjustable feed chutes or gates are provided at the lower ends of the stream to provide further flexibility and achieve good tramp removal with low fiber loss. The arrangement accomplishes a fan inducting layout which requires less area than existing systems.

Other objects, advantages and features will become more apparent with the teaching of the principles of the invention in connection with the disclosure of the preferred embodiments thereof in the specification, claims and drawings in which:

DESCRIPTION OF THE PREFERRED EMBODIMENTS

Figure 1:
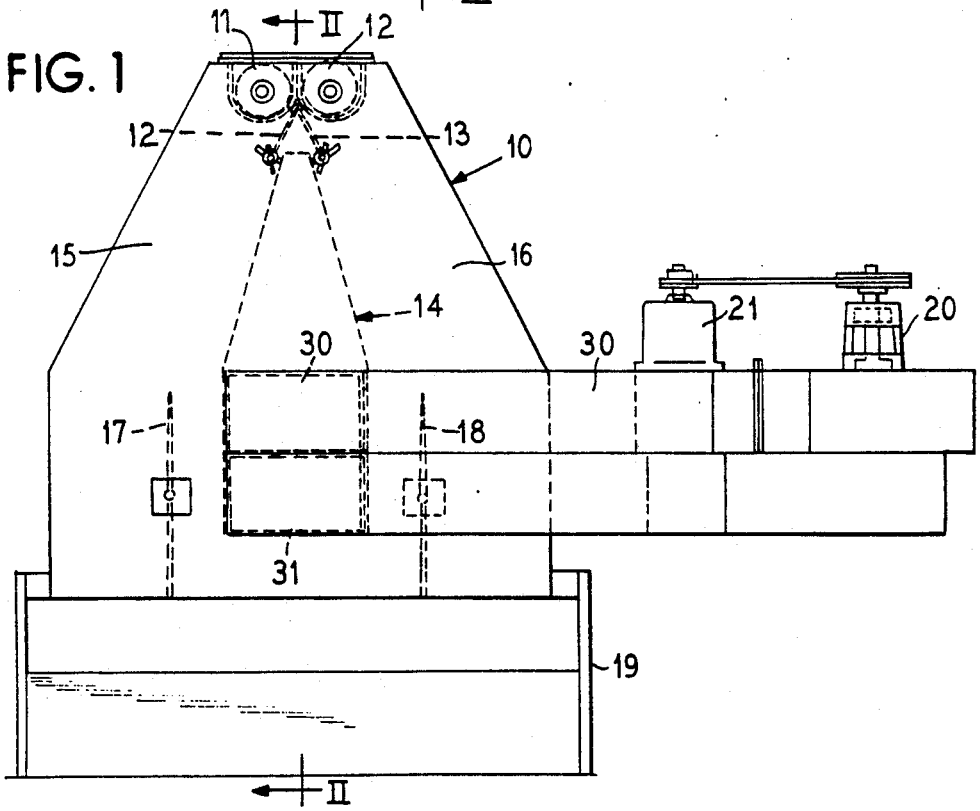
FIG. 1 is a front elevational view of a separation system embodying the principles of the present invention.

FIG. 1 illustrates the separating mechanism as enclosed in a housing 10. The stock material containing fibers with tramp rejects therein is delivered to the housing via a pair of parallel arranged horizontal screw conveyors 11 and 12. The material is dropped over the width of the machine from the screw conveyors in separate parallel sheets to form downwardly descending streams 15 and 16.

The individual streams are deflected outwardly at a predetermined select angle by panels 12 and 13 which are adjustable as to angle, preferably in the range of 5° to 15°. This angle will be set by the operator dependant upon the nature of the fibers, the amount of tramp material and the air pressure to be selected for the nozzles which direct a flow of air across each of the streams.

As the streams 15 and 16 descend gravitationally downwardly, the acceptable fibers are blown outwardly and the heavier tramp material falls directly downwardly. Near the lower portion of the streams are dividers which are in the form of gates 17 and 18 to achieve flexibility and achieve good tramp removal. By adjustment of the angle of the gates, the zone inside of the gates for tramp removal is increased or decreased and the zone outside for the descent of acceptable fibers is increased or decreased.

Figure 3:
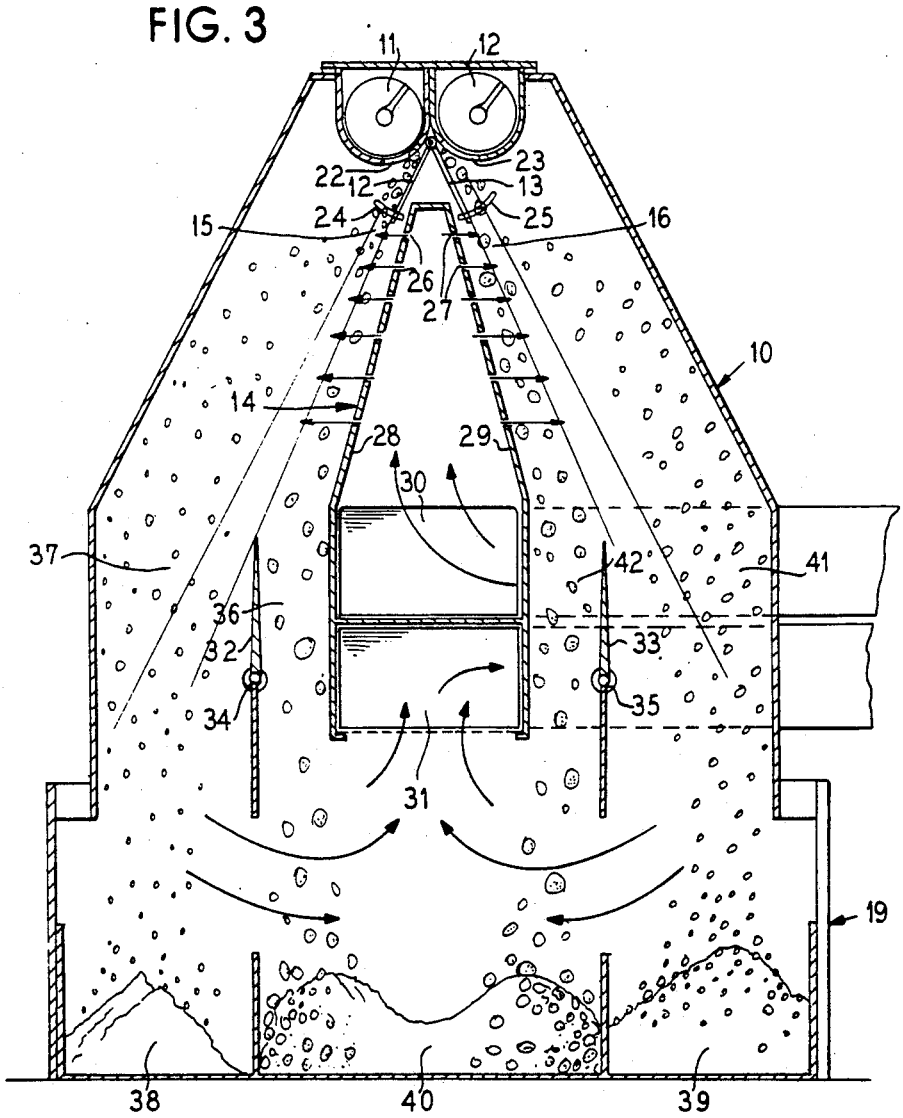
FIG. 3 is a vertical sectional view taken substantially along line III—III of FIG. 2.
Figure 4:
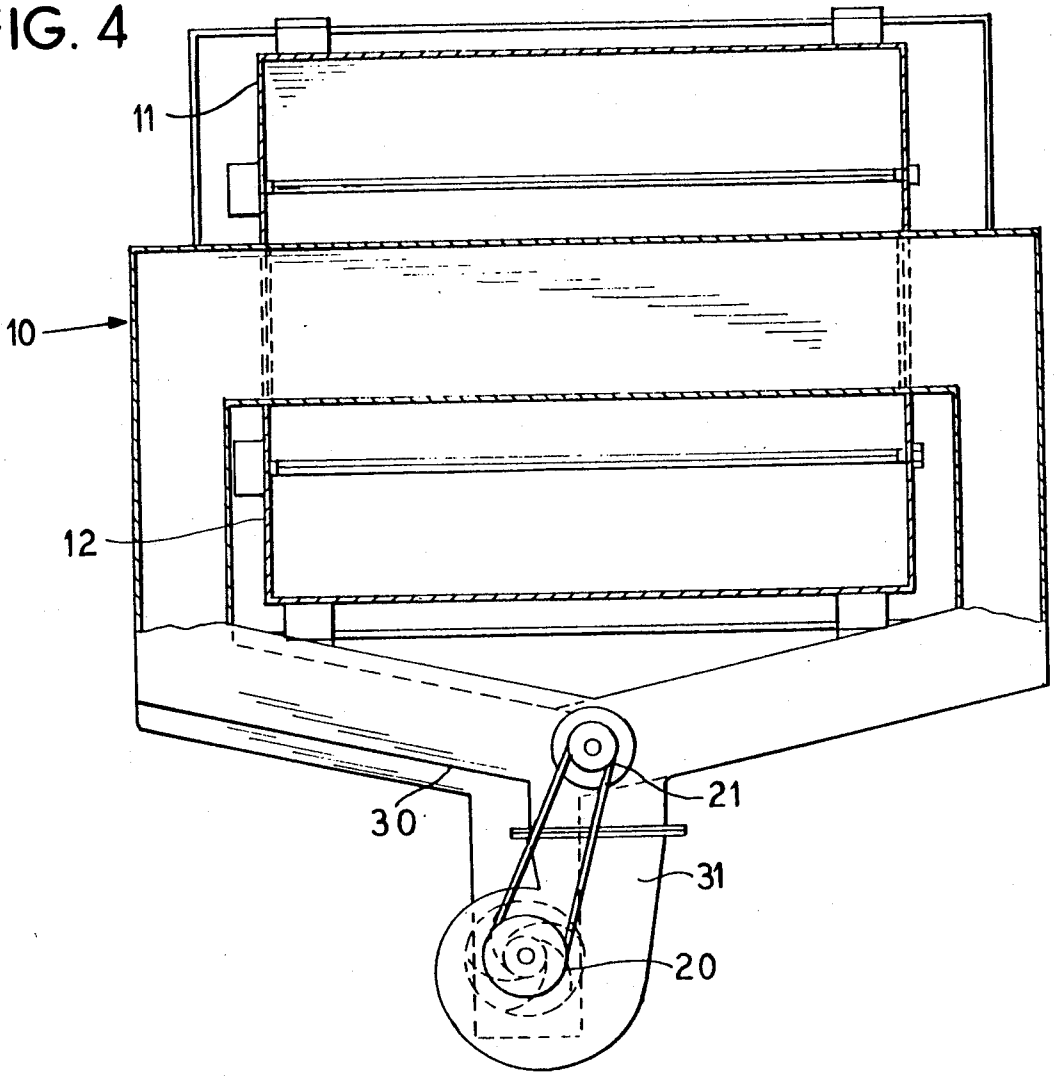
FIG. 4 is a top plan view of the mechanism.

The air supply is generated by a blower 20 driven by a motor 21, FIGS. 1 and 4, and air is delivered to a plenum arrangement 14 through a conduit 30, FIG. 3. The air is recirculated with the return air passing downwardly and returned to a conduit 31 which leads to the intake of the fan 20.

Referring to the mechanism and process more specifically, FIG. 3 illustrates the screw conveyors which rotate in elongate horizontal housings and have slotted openings 22 and 23 arranged along the width of the housing 10 so that the fibers with the tramp material is distributed relatively uniformly along the housing to descend in the wide streams 15 and !6. As the fibers are released to descend gravitationally from the screw conveyors through the openings 22 and 23, the streams are deflected outwardly by the panels 12 and 13. These panels are pivotally supported at their upper ends and their lower ends are fixedly set for adjustment means in slots 24 and 25. The angle of the panels is adjusted and fixed by the operator as a function of the type of fibers treated and the tramp materials which are included in the fibers. Preferably the adjustment of the panels ranges from an angle of between 15° to 20° from the vertical.

Figure 2:
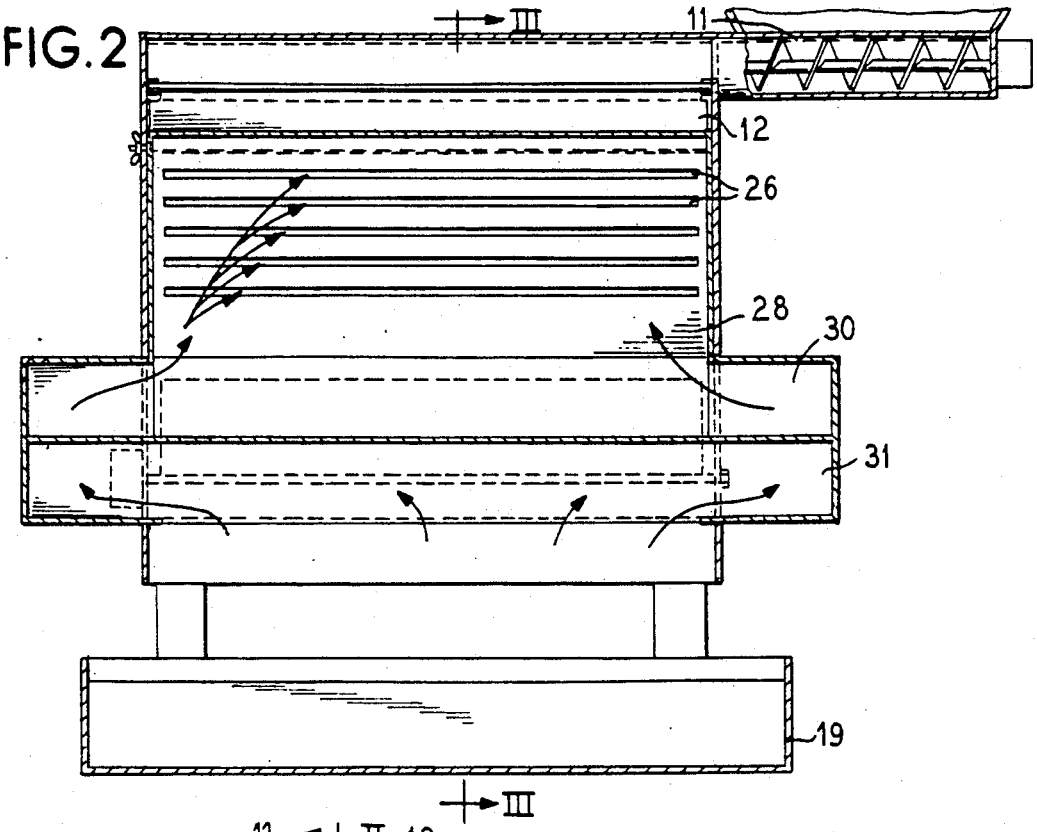
FIG. 2 is a vertical sectional view taken substantially along line II—II of FIG. 1.

As the supply of fibers descends in the divided streams downwardly, curtains of air are directed horizontally across the streams through slotted openings 26 and 27, FIGS. 2 and 3. These curtains of air are directed horizontally as indicated by the arrowed lines and as the streams of fibers pass through the sequential curtains in a downward direction, the fibers are repeatedly acted on to be blown outwardly toward the outer portion of the housing 10 into outer streams of fibers 37 and 41. The heavier tramp material will be less affected by the curtains of air and will flow more directly vertically downwardly in streams at 36 and 42.

As will be seen from FIG. 3, as the streams of fibers flow downwardly, the air nozzles which form the curtains of air are positioned increasingly outwardly toward the stream. The plenum 14 which supports the slotted nozzles has walls which are inclined outwardly in a downward direction. The angle of the walls is slightly less than the angles of the panels 12 and 13. For example, if the panels have a minimum angle of 15°, the walls would be set at an angle of 15° and the panels, of course, can then be increased in their angle. As the fibers fall downwardly, they are acted on again and again by succeeding curtains of air emitting from the nozzles in the walls of the plenum 14.

As the streams flow downwardly, separation between the rejects in the zones 36 and 42 has occurred and the zones for the rejects 36 and 42 are separated from the zones from the acceptable fibers 37 and 41 by the gates 32 and 33. Gate 32 is pivotally mounted at 34 and gate 33 is pivotally mounted at 35. The gates are mounted to be adjustable in their vertical angle about their pivotal supports 34 and 35 so that they can be pivoted outwardly or inwardly to increase or decrease the size of the zones through which the rejects fall and the zones through which the acceptable fibers fall. This increases the effectiveness and the flexibility of the unit and the operator will set the angular position of the gates 32 and 33 in accordance with the material being treated and in accordance with the effect of the air curtains.

The rejects fall downwardly in a central bin 40, and the acceptable fibers fall into fiber bins 38 and 39. It will be apparent that all of the fibers are retained so that there is no fiber loss.

The air flow after passing downwardly, turns inwardly as indicated by the arrowed lines to pass up into the return plenum 31.

In operation, a continual supply of fibers to be separated and cleaned is fed into the dual screw conveyors and 12, in a dry state, and the fibers with the reject material are released to drop downwardly in divided streams and 16. The angle of the streams is deflected outwardly by the panels 12 and 13 and the streams are immediately engaged by lateral curtains of air emitting through the slots 26 and 27. The curtains of air emanate from the plenum 14 and are discharged at a location which is located further outwardly in a descending direction. The heavier tramp material falls downwardly into the zones 36 and 42 inwardly of the gates 32 and 33, and the acceptable fibers are captured in their entirety in the outer portions 37 and of the streams. Periodic removal of the tramp material is performed from the bin 40 at the bottom of the housing 10, and removal of the acceptable fibers is made from the bins 38 and 39.

Thus, it will be seen that I have provided an improved method and apparatus for the separation and cleaning and preparation of fibers for a papermaking machine which meets the objectives and advantages above set forth and provides for greater efficiency and a greater volume of operation with a simplified mechanism. Better preparation of fibers insures improved quality of pulp and paper.

I claim as my invention:

1. A mechanism for separating rejected material from acceptable fibers for papermaking comprising in combination:

means for delivering a flow of fibers with mixed reject material and releasing the flow to descend gravitationally downward in at least two separate descending streams;

adjustment means for controlling the downward angle of release of said streams;

and lateral air flow delivery means directing flows of air laterally across each of said streams so that heavier reject material falls through the air flow and fibers are carried laterally outwardly of each stream to deposit downwardly in flows of acceptable fibers, said lateral air flow delivery means including a central plenum chamber between separate descending streams, with a plurality of air flow nozzles laterally of the chamber to direct a plurality of streams of air laterally across the streams of fibers.

2. A mechanism for separating reject material from acceptable fibers for papermaking constructed in accordance with claim 1:

wherein means are provided gathering the air passing across the streams and recirculating said air to said plenum.

3. A mechanism for separating reject material from acceptable fibers for papermaking constructed in accordance with claim 1:

wherein said adjustment means includes angled panels for deflecting the fibers outwardly.

4. A mechanism for separating reject material from acceptable fibers for papermaking constructed in accordance with claim 3:

wherein said panels have means for adjusting the angles to control the downward angle of release of the streams.

5. The method of separating reject material from acceptable fibers for papermaking comprising the steps:

delivering a flow of fibers with mixed reject material to descend gravitationally downwardly in at least two separate descending streams;

and directing a lateral air flow into each of the separate descending streams from between adjacent descending streams through a plurality of air outlet openings providing a curtain of air for deflecting the fibers outwardly from a vertical path with the reject material descending in the vertical path.

6. The method of separating reject material from acceptable fibers for papermaking in accordance with the steps of claim 5:

including adjusting the angle of flow of the separate descending streams.

7. The method of separating reject material from acceptable fibers for papermaking in accordance with the steps of claim 5:

including dividing each of the streams downstream of the lateral air flow into a zone of accepts and a zone of rejects.

8. The method of separating reject material from acceptable fibers for papermaking in accordance with the steps of claim 7:

including adjusting the location of said zones to change the area of rejects and the area of accepts.

9. The method of separating reject material from acceptable fibers for papermaking in accordance with the steps of claim 5:

including directing said lateral air flow from a common source to engage the streams at equal pressures.

10. The method of separating reject material from acceptable fibers for papermaking in accordance with the steps of claim 5:

including controllably changing the angle at which the streams are released to descend gravitationally downwardly to a predetermined angle.

11. A mechanism for separating reject material from acceptable fibers for papermaking comprising in combination:

a pair of parallel screw conveyors having discharge openings for conveying and discharging a flow of fibers with mixed reject material in a pair of parallel vertical streams;

panels positioned beneath the screw conveyors to deflect said streams individually outwardly;

adjustment means for adjusting the angle of the panels to adjust the outward angle of the streams to predetermined angles;

an air delivery plenum positioned beneath the panels with separate outwardly facing air nozzles directed toward each of the streams to direct horizontal flows of air across the streams so that heavier reject material falls through the air flow and fibers are carried laterally outwardly of each stream to deposit downwardly in a flow of acceptable fibers;

the nozzles being arranged at an angle to flare outwardly in a downward direction;

vertical walls positioned beneath the air flows to divide each of said streams into a zone of reject material and a zone of acceptable fiber materials outwardly therefrom;

pivotal mounts for each of said walls to change the attitude angle of the walls and control the area of said zones;

an air gathering plenum positioned to receive air at the lower end of said streams;

means communicating said air gathering plenum and said air delivery plenum so that air is recirculated.

* * * * *

UNITED STATES PATENT AND TRADEMARK OFFICE

CERTIFICATE OF CORRECTION

PATENT NO. : 5,110,453

DATED : May 5, 1992

INVENTOR(S) : James R. Montgomery

It is certified that error appears in the above—identified patent and that said Letters Patent is hereby corrected as shown below:

Column 3, Line 65, should read --11-- before "and 12"; line 67 should read --15-- before "and 16".

Column 4, Line 8, after "37 and" should read --41--.

Signed and Sealed this

Sixth Day of July, 1993

Michael K. Kirk

MICHAEL K. KIRK

*Acting Commissioner of Patents and Trademarks*

*Attest:*

*Attesting Officer*